United States Patent [19]

Newby

[11] Patent Number: 4,786,378

[45] Date of Patent: Nov. 22, 1988

[54] CHROMIUM ELECTROPLATING BATHS HAVING REDUCED WEIGHT LOSS OF LEAD AND LEAD ALLOY ANODES

[75] Inventor: Kenneth R. Newby, Berkeley Heights, N.J.

[73] Assignee: M&T Chemicals Inc., Woodbridge, N.J.

[21] Appl. No.: 91,626

[22] Filed: Sep. 1, 1987

[51] Int. Cl.[4] ..... C25D 3/10; C25D 3/56

[52] U.S. Cl. ..... 204/43.1; 204/51

[58] Field of Search ..... 204/51, 43.1

[56] References Cited

U.S. PATENT DOCUMENTS

| | | | |
|---|---|---|---|
| 1,590,170 | 6/1926 | Hosdowich | 204/51 |
| 3,857,683 | 12/1974 | Castonguay | 204/43.1 X |
| 4,588,481 | 5/1986 | Chessin et al. | 204/51 |

*Primary Examiner*—G. L. Kaplan

*Attorney, Agent, or Firm*—S. A. Marcus; W. Katz

[57] ABSTRACT

Weight loss of lead and lead alloy anodes is substantially reduced by including bismuth arsenic or antimony ions in the plating bath.

8 Claims, No Drawings

CHROMIUM ELECTROPLATING BATHS HAVING REDUCED WEIGHT LOSS OF LEAD AND LEAD ALLOY ANODES

BACKGROUND OF THE INVENTION

1. Field of the Invention

This invention relates to the electrodeposition of chromium using lead or lead alloy anodes, and, more particularly, to a chromium plating bath system and process, in which weight loss of such lead anodes is substantially reduced.

2. Description of the Prior Art

Chromium plating baths using chromic acid solutions as the source of chromium almost invariably employ lead or lead alloy anode. However, as described in the book "The Electrochemistry of Lead" by A. T. Kuhn, Academic Press (1979) pages 405–407, lead and lead alloy anodes corrode to a soluble species (leading to anode weight loss) in chromic acid solutions. This anode dissolution proceeds at a substantial rate, which is proportional to the acidity of the solution. For this reason, there has been a need to find corrosion resistant alloys for this medium. For example, alloys containing 10% Sn and 0.5% Co seem to show good resistance. Also the addition of 1–2 g/l of $Co^{2+}$ ions appears to further reduce corrosion.

While this problem is present in the conventional hexavalent chromium plating baths and in the mixed catalyst chromium baths, it is particularly acute in high energy efficient baths, e.g. the so-called "HEEF-25" baths as described in the U.S. Pat. No. 4,588,481. HEEF-25 baths contain chromic acid, sulfate and an alkyl sulfonic acid, which, for functional chromium deposits, is preferably a non-substituted alkyl sulfonic acid, or salt thereof, wherein the ratio of S/C is $\geqq \frac{1}{3}$. Typical alkyl sulfonic acids are methyl sulfonic acid, ethyl sulfonic acid, propyl sulfonic acid, methane disulfonic acid and 1,2-ethane disulfonic acid.

Other hexavalent chromium plating baths are described in the following U.S. Pat. Nos.: 2,750,337; 3,310,480; 3,311,548; 3,745,097; 3,654,101; 4,234,396; 4,406,756; 4,450,050 and 4,472,249.

Accordingly, it is an object of the invention to provide a chromium plating bath in which the rate of weight loss or pitting of a lead or lead alloy anode is substantially reduced.

Another object of the present invention is to provide an additive for a hexavalent chromium plating bath containing an alkyl sulfonic acid, which substantially reduces the corrosion of a lead or lead alloy anode therein, which corrosion produces a soluble species leading to anode weight loss.

Still another object of the invention is to provide a method of preventing such deleterious corrosion of a lead or lead alloy when used in a hexavalent chromium plating bath, particularly in a high energy efficient bath.

These and other objects and features of the invention will be made apparent from the following more particular description of the invention.

SUMMARY OF THE INVENTION

What is provided herein is an improved chromium plating bath which substantially reduces corrosion of a lead or lead alloy anode used therein to a soluble species leading to anode weight loss. The bath of the invention includes a source of chromium metal, and a source of bismuth, arsenic or antimony ions, which ions perform as an anode corrosion-inhibiting additive therein.

As a feature of the invention, the anode corrosion-inhibiting additive herein is effective in various chromium plating baths including the conventional, mixed catalyst, or alkyl sulfonic acid-containing (HEEF-25) types.

In the preferred form of the invention, the corrosion-inhibiting additive is bismuth ion, which is present in an amount at least sufficient to effect the desired result, suitable at least about 0.01 g/l to 25 g/l, and, preferably about 0.1 to 5 g/l.

DETAILED DESCRIPTION OF THE INVENTION

In accordance with the invention, a typical chromium plating bath exhibiting substantially reduced solubilizing corrosion of lead or lead anodes used therein includes:

(a) a source of chromium metal and catalyst therewith; and (b) a source of bismuth arsenic or antimony ions as an anode corrosion-inhibiting additive therewith.

A preferred chromium electroplating system comprises:

(a) a lead or lead alloy anode;

(b) a cathode, (c) a hexavalent chromium electroplating bath solution including:

(i) a source of chromium and catalyst for deposition of chromium on said cathode, and, (ii) a source of bismuthions to substantially reduce solubilizing corrosion of said anode during deposition of chromium metal on said cathode or while the anode is at open circuit.

In the most advantageous commercial use of the invention, the hexavalent chromium plating bath is the HEEF-25 type, as described in U.S. Pat. No. 4,588,481. This bath contains an alkyl sulfonic acid, where the S/C ratio is $\geqq 1/3$, e.g. methyl sulfonic acid, in an amount of 1–18 g/l, chromic acid in an amount of 100–450 g/l, and sulfate as a catalyst in an amount of 1–5 g/l.

The bismuth ion is suitably present in the bath in an amount sufficient to effect the desired retardation of corrosion of the lead and lead alloy anodes used in chromium plating. Deleterious corrosion produces a soluble species of divalent lead which results in anode pitting or weight loss. On the other hand, corrosion of the alloy to dense $PbO_2$, which is insoluble, is not harmful.

Thus, while the mechanism of the action of bismuth in preventing solubilizing corrosion of lead or lead alloy anodes is not completely understood, it is believed that a bismuth ion or anion migrates to the anode leaving a dense and adherent black film of mixed oxides of bismuth and lead on the anode. The presence of this black film is believed to prevent further solubilizing corrosion of the anode.

The bismuth ion may be provided in combination with an anion, which, however, preferably does not accelerate the dissolution of the lead anode. Bismuth oxide, a bismuthate, or bismuth salts are preferred because their lead salts are soluble compounds.

The invention now will be illustrated by reference to the following examples.

EXAMPLE 1

A. A chroium plating solution was prepared from 250 g/l chromic oxide, 2.5 g/l sodium sulfate, and 3.5 g/l methane sulfonic acid. The anode was a Pb-7% Sn alloy. Electroplating of chromium was carried out at an anode current density of 1.5 a.s.d. at 60° C., a total of 1,050 amphere-hours, after which the anode was inspected. The anode had a dark brown film thereon and was slightly corroded and pitted.

B. Example A was repeated with the addition of 5 g/l of sodium bismuthate. A black film formed on the anode, and its surface was smooth, with no visible solubilizing corrosion.

EXAMPLE 2

A. A hexavalent chromium plating bath for accelerated testing was prepared by mixing 100 g/l chromic oxide into a 10% by volume solution of methyl sulfonic acid, and adding 2.0 g/l of sodium bismuthate. A lead-7% tin oxide anode was used for plating, which was carried out for 4 min. at 15 amps. The Faradaic weight loss of the lead alloy anode was observed to be only 1.8%, and a dark, dense $PbO_2$ film formed on the anode.

B. Example A was repeated without sodium bismuthate being present. The Faradaic weight loss increased substantially to 7.5%.

C. Example A was repeated without chromic oxide being present in the bath. The anode weight loss indicated 100% efficiency in forming soluble $Pb^{2+}$.

D. Example B was repeated without chromic oxide being present in the bath. The anode weight loss indicated 100% efficiency in forming soluble $Pb^{2+}$.

EXAMPLE 3

Examples 1A–C were repeated using 5 g/l of sodium arsenate, sodium antimonate, and 5% phosphoric acid. Reduction of weight loss of the anode was observed.

EXAMPLE 4

Bismuth oxide was substituted for sodium bismuthate in the above examples with similar results.

While the invention has been described with reference to certain embodiments, it will be understood that changes and modifications may be made which are within the skill of the art. It is intended to be bound by the appended claims only.

What is claimed is:

1. A chromium electroplating bath in which solubilizing corrosion of a lead or lead alloy anode used therein is substantially reduced comprising:

(a) a source of said chromium, (b) an alkyl sulfonic acid or salt thereof, wherein the S/C ratio is $\geqq \frac{1}{3}$, and (c) a source of bismuth, arsenic or antimony ions as an additive therein, to reduce weight loss or pitting of said anode.

2. A chromium plating bath according to claim 1 wherein (c) is bismuth ion.

3. A chromium plating bath according to claim 2 wherein said bismuth ion is present in an amount of about 0.01 g/l to 25 g/l.

4. A chromium plating bath according to claim 3 wherein said bismuth ion is present in an amount of about 0.1 g/l to 5 g/l.

5. A chromium plating bath according to claim 1 wherein said source of bismuth ions is a bismuth oxide or an alkali metal bismuthate.

6. A chromium plating bath according to claim 1 wherein said chromium bath includes chromic oxide and a catalyst.

7. A chromium plating bath according to claim 6 wherein said alkyl sulfonic acid is selected from methyl sulfonic acid, ethyl sulfonic acid, propyl sulfonic acid, methane disulfonic acid and 1,2-ethane disulfonic acid.

8. A chromium plating bath according to claim 7 wherein the chromic acid concentration is about 100–450 g/l, the alkyl sulfonic acid concentration is about 1–18 g/l and the catalyst is sulfate in a concentration of about 1–5 g/l.

* * * * *